United States Patent [19]

Kranz

[11] Patent Number: 4,964,592

[45] Date of Patent: Oct. 23, 1990

[54] FLUID DISTRIBUTOR

[75] Inventor: Walter Kranz, Taufkrichen, Fed. Rep. of Germany

[73] Assignee: Messerschmitt-Bölkow-Blohm GmbH, Munich, Fed. Rep. of Germany

[21] Appl. No.: 429,853

[22] Filed: Oct. 31, 1989

[30] Foreign Application Priority Data

Nov. 10, 1988 [DE] Fed. Rep. of Germany ..... 3838100

[51] Int. Cl.[5] ..... F41G 7/00; F42B 15/01

[52] U.S. Cl. ..... 244/322

[58] Field of Search ..... 244/3.22

[56] References Cited

U.S. PATENT DOCUMENTS

| | | | |
|---|---|---|---|
| 4,211,378 | 7/1980 | Crepin | 244/3.22 |
| 4,589,594 | 5/1986 | Kranz | 239/265.25 |
| 4,646,991 | 3/1987 | Kranz | 244/3.22 |
| 4,681,283 | 2/1987 | Kranz | 244/3.22 |
| 4,691,876 | 9/1987 | Kranz | 244/3.22 |
| 4,747,568 | 5/1988 | Carrigan | 244/3.22 |
| 4,852,827 | 8/1989 | Kranz | 244/3.22 |

*Primary Examiner*—Charles T. Jordan

*Assistant Examiner*—Rochelle Lieberman

*Attorney, Agent, or Firm*—Kenyon & Kenyon

[57] ABSTRACT

A fluid distributor with a body of revolution, which is arranged around an axis of rotation and has a fluid passage communicating with a fluid source, as well as an exhaust passage, which is connected to this fluid passage and emerges from the side wall of the body of revolution, and fluid flows out of this exhaust passage as a fluid jet, in a direction which does not intersect the axis of rotation of the body of revolution, such that the body of revolution is set into rotation. To enable a back and forth motion of the body of revolution, with such an arrangement, between two stops, a jet baffle is provided, which is not connected to the body of revolution and which, when the body of revolution contacts the second stop, diverts the major portion of the fluid jet emerging from the exhaust passage in the direction of rotation, so that the fluid jet then acts on a supporting surface provided on the body of revolution to reverse the direction of rotation. A releasable brake is provided to retain the body of revolution in both positions. The fluid distributor can be used to guide missiles, for example in connection with quick-motion hot-gas valves.

7 Claims, 3 Drawing Sheets

FIG. 1
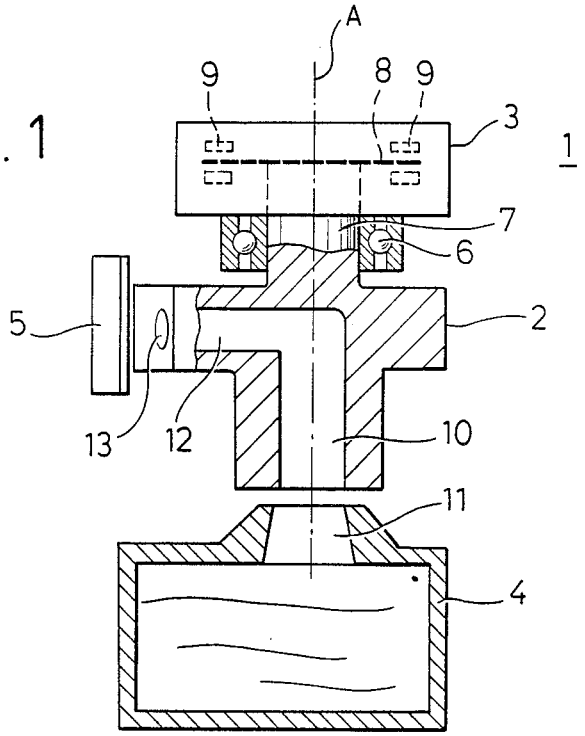
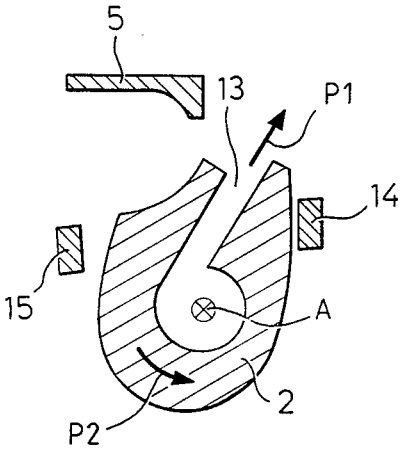
FIG. 2a
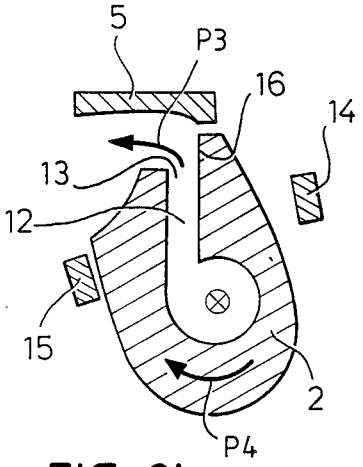
FIG. 2b

FLUID DISTRIBUTOR

BACKGROUND OF THE INVENTION

The present invention relates to a fluid distributor.

Such a fluid distributor is known from the German Patent No. 33 17 583. This fluid distributor has a body of revolution, which is arranged around an axis of rotation, and a fluid divider, which communicates with a fluid source and is also connected to an exhaust passage, which emerges from the side wall of the body of revolution. The fluid emerges as a fluid jet out of this exhaust passage in a direction, which does not intersect the axis of rotation of the body of revolution, so that an angular momentum is exerted on the body of revolution, consequently setting this body in rotation. A releasing and restraining device, for example, a type of releasable brake, is provided to retain the bodies of revolution in fixed rotational positions and to guide them into other rotational positions. The known fluid distributor can be designed in a highly miniaturized version and used, for example, to guide small-caliber missiles. In this case, the body of revolution is mounted in the missile, whereby this missile features several perforations in its side wall, through which the fluid jet can be guided into the open air in a controlled operation, thereby exerting a transverse force on the missile.

The known fluid distributor can also be used in the operation of a miniaturized hot-gas engine, as is likewise described in the mentioned patent.

In principle, the known fluid distributor can be used with any type of fluid, for example gas, fluid, a gas/solid mixture, etc. In this sense, the term "fluid" shall be used in the following as well.

A multitude of applications are conceivable, where such a fluid distributor could be used. However, essentially only two functional positions of the body of revolution are of importance. They can be defined as the active or inactive position. The known fluid distributor can be used, for example, in a secondary injection system. In this case, all that matters in the active position is guiding a reacting fuel into the propelling jet of a discharge nozzle or preventing this in the inactive position. Since the known fluid distributor, provided that it only has one exhaust passage for the fluid, must always cover a complete revolution, that is, an angle of rotation of 360°, in order to attain the starting position again, the time it takes to rotate from the active position to the inactive position, or reverse, must be accepted as dead time.

This dead time can be reduced, when the bodies of revolution are provided with two exhaust passages on opposite sides of the wall of the body of revolution. The fluid jets emerging from the exhaust passages then exert oppositely directed angular momenta on the bodies of revolution. Then, when one exhaust passage is covered, the body of revolution executes vibratory movements, unless it is stopped by the brake in one of the two positions. Thus, such a fluid distributor requires a body of revolution with two exhaust passages and a cover surrounding the body of revolution with two perforations allocated to the exhaust passages of the body of revolution.

SUMMARY OF THE INVENTION

An object of the present invention is to provide a fluid distributor of the type mentioned, which, with minimal constructional expenditure, can be guided into two selected rotational positions. At the same time, a good dynamic performance, that is short switching times and short dead times, shall be attained. Also, the fluid distributor shall still be able to be miniaturized, to a considerable extent.

The above and other objects of the invention are achieved by a fluid distributor with a body of revolution, which is arranged around an axis of rotation and has a fluid passage communicating with a fluid source, and with an exhaust passage, the exhaust passage emerging from the side wall of the body of revolution, whereby fluid flows out of the exhaust passage as a fluid jet in a direction which does not intersect the axis of rotation of the body of revolution, setting the body of revolution into rotation, further comprising a restraining and releasing device for the body of revolution to retain the body of revolution in a fixed rotational position and to release the body of revolution out of this rotational position, and further comprising:

first and second stops for limiting the turning capacity of the body of revolution, whereby the body of revolution abutting against the first stop turns in the direction of the second stop, when said body of revolution is released by the restraining and releasing device;

a jet baffle unconnected with the body of revolution and disposed opposite the exhaust passage of the body of revolution in the discharge direction of the fluid, when the body of revolution abuts against the second stop, and diverts the major portion of the fluid jet emerging from the exhaust passage in the direction of rotation; and a supporting surface provided on the body of revolution, the diverted fluid jet pushing against the supporting surface after emerging from the exhaust passage, so that the body of revolution released by the restraining and releasing device is rotated from the second stop in the direction of the first stop and makes contact therewith.

Accordingly, in both rotational positions of the body of revolution, oppositely directed angular momenta are exerted on the body. Thereby, in the second position, this angular momentum is generated by externally guiding the flow of the fluid jet emerging from the body of revolution. This solution is structurally very simple, is able to be miniaturized to a considerable extent, and can be produced with a few light components. Therefore, all in all, a fluid distributor is provided, which can swivel between two positions and exhibits a good dynamic performance, that is short switching and dead times.

In accordance with the invention, the fluid distributor has many varied applications. Among these are steering a missile or operating a hot-gas engine, as mentioned above, or also switching high-capacity valves, for instance slide valves used in missile guidance.

BRIEF DESCRIPTION OF THE DRAWINGS

The invention will be described in greater detail in the following detailed description with reference to the drawings, in which:

FIG. 1 is a schematic, partially cut-away view of a fluid distributor, according to the invention, with a body of revolution, which can swivel between two rotational positions;

FIGS. 2*a* and 2*b* are a cut-away top view of the body of revolution in both rotational positions.

DETAILED DESCRIPTION

Figure 3A:
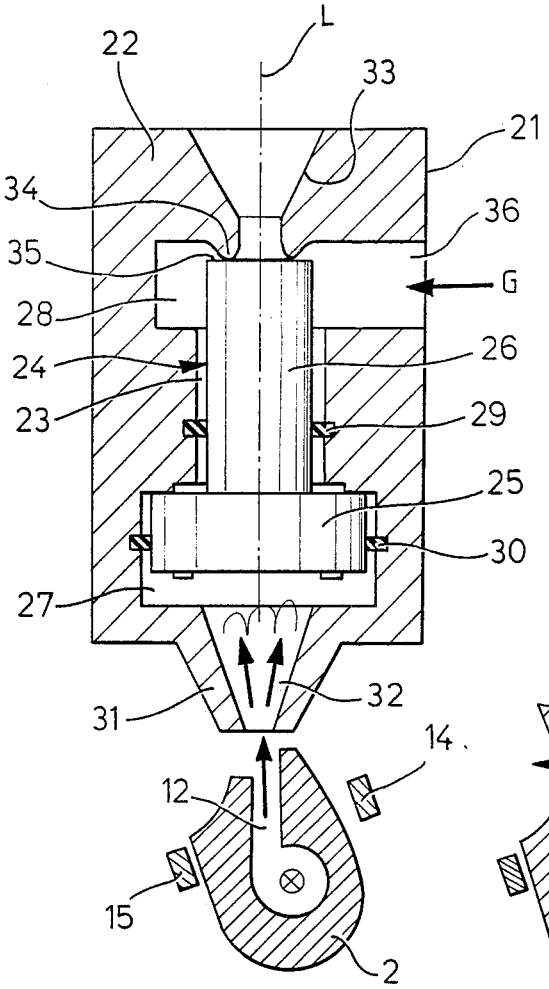
FIGS. 3*a*, 3*b* and 4 are schematic, respectively cutaway representations of a quick-motion slide valve with a fluid distributor, in accordance with the invention, in different rotational positions of the body of revolution.

With reference now to the drawings, FIG. 1 depicts a fluid distributor 1 with a body of revolution 2, a restraining and releasing device for the body of revolution 2 designed as a releasable brake 3, a gas generator 4 as a fluid source, and a baffle designed as a deflector plate 5.

The body of revolution 2 is pivoted on an axis of rotation A with the help of a ball bearing 6, whereby the ball bearing 6 encircles an upper neck 7 of the body of revolution 2. This neck 7 leads into the releasable brake 3 and is connected therewith by a friction disk 8, which interacts with brake shoes 9. The embodiment of the bearing arrangement and brake shown are merely exemplary.

A fluid passage 10 is provided in the body of revolution 2. It is situated, in this case, coaxially to the axis of rotation A, and it communicates on the bottom side of the body of revolution 2 with an orifice 11 of the gas generator 4. Below the neck 7 of the body of revolution, this fluid passage 10 turns into an exhaust passage 12, which runs more or less perpendicularly to the axis of rotation A and emerges at the side wall of the body of revolution 2 in an orifice 13.

As illustrated in FIG. 2, two stops 14 and 15 are also provided, which limit the turning capacity of the body of revolution. In the present case, the body of revolution is designed in cross-section as an elongated, cut-off oval, so that the stops 14 and 15 work together directly with the side wall of the body of revolution. Of course, other solutions are possible in this case, as well.

The mode of operation of the fluid distributor 1 is explained in greater detail based on FIG. 2. In FIG. 2*a*, the body of revolution 2 is depicted in the first rotational position, where it abuts against the first stop 14. The hot gas streaming out of the gas generator 4 is directed via the fluid passage 10 into the exhaust passage 12 and emerges out of the orifice 13 more or less perpendicularly to the axis of rotation A in the direction of the arrow P1, whose direction is determined by the longitudinal axis of the exhaust passage 12. As is apparent in FIG. 2, this longitudinal axis does not intersect the axis of rotation A of the body of revolution, so an angular momentum is exerted on the body of revolution 2, forcing the body of revolution into a rotation, shown counterclockwise in the Figure, as indicated by the arrow P2. However, if the body of revolution 2 is arrested by the releasable brake 3, then it remains in the position shown in FIG. 2*a*.

If the brake 3 is now released, then the body of revolution 2 turns in the direction of the second stop 15, until it strikes against this stop and is retained there again by the newly activated brake 3. This rotational position is depicted in FIG. 2*b*. In this position, the fluid jet emerging from the exhaust channel 12 hits the deflector plate 5 and, in this case, is deflected by approximately 90°, as indicated by the arrow P3. The body of revolution 2 is now designed such that the deflected jet can push against a supporting surface 16, which joins up with the orifice 13 of the exhaust channel 12 on the side assigned to the axis of rotation A. The hot-gas jet emerging along the arrow P3 now exerts an angular momentum on the body of revolution 2 in the clockwise direction, as indicated by the arrow P4. Now, if the brake 3 is released, then the body of revolution 2 is turned by this angular momentum in the direction of the first stop 14. The arrangement and refinement of the deflector plate 5, the dimensioning of the supporting surface 16 and the turning capacity of the body of revolution 2 are adjusted by measuring such that, as a result of this clockwise angular momentum, the body of revolution 2 rotates to the first stop 14, where it is again retained with the help of the brake 3. This interplay of forces can then be repeated, as desired.

The fluid emerging from the exhaust passage 12 can be utilized in both rotational positions of the body of revolution, for example to guide a missile, to regulate a final control element or the like.

The described fluid distributor of FIGS. 3 and 4 is used in connection with a quick-motion, high-capacity slide valve 21 to steer a missile. This slide valve has a housing 22 with a seal chamber 23, in which a double-diameter piston 24, consisting of a piston 25 and a piston rod 26, is supported in a sliding configuration. The seal chamber 23 consists of a lower and an upper piston space 27 or 28, whereby the piston 25 is situated in the lower piston space 27 and the piston rod 26 extends into the upper piston space 28. Both the piston rod 26, as well as the piston 25, slide in sealing guideways 29 or 30. A neck 31 with a borehole 32 joins up with the lower piston space 27. This borehole lies directly across the exhaust passage 12 of the body of revolution 2, when the body of revolution 12 abuts against the second stop 15. The center axis of the borehole 32 lies in the longitudinal axis L of the double-diameter piston 24, which, at the same time, is the sliding axis. This longitudinal axis is also the center axis of a discharge nozzle 33, which empties into the upper piston space 28. The orifice of the discharge nozzle 33 emptying into the piston space 28 is surrounded by a supporting edge 34. The end face of the piston rod 26 can push against this supporting edge, as shown in FIG. 3, so that a free annular surface 35 still remains outside of the supporting edge 34. A borehole 36 leads laterally into the upper piston space 28 and hot gas G is introduced into this piston space through the borehole 36.

Figure 3B:
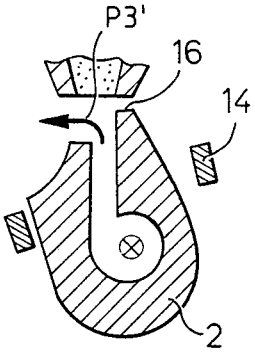
Figure 4A:
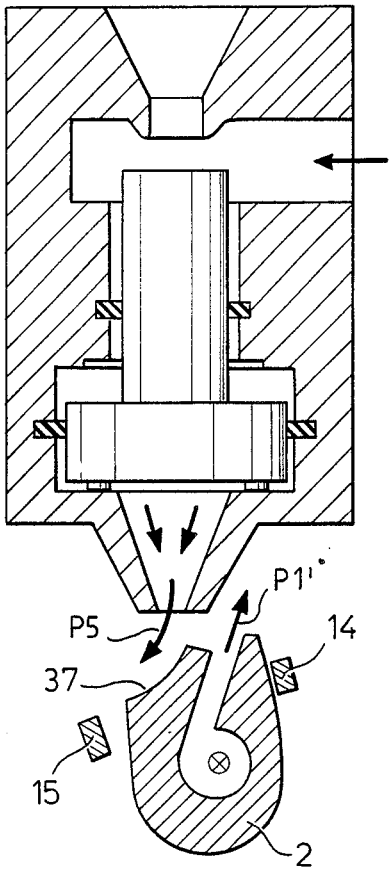

The depicted arrangement functions as follows:

When the body of revolution 2 is in the position in accordance with FIG. 3*a*, fluid from the exhaust passage of the body of revolution 2 is injected via the borehole 32 into the lower piston space 27, by which means the double-diameter piston 24 is pressed upwards, until its free end face contacts the supporting edge 34. The hot gas G is thereby stopped and cannot emerge from the discharge nozzle 33, since the force of the hot gas G, which acts on the annular surface 35 of the double-diameter piston is smaller than the force of the fluid, which is exerted on the lower bottom surface of the piston 25. When the piston space 27 is filled up, no more fluid can enter into this space. As shown in FIG. 3*b*, the fluid jet is then diverted by 90° along the arrow P3'. The filled piston space 27 and the neck 31 thus assume the function of the deflector plate 5 depicted in FIG. 2. The diverted fluid jet, in turn, then presses against the supporting surface 16 of the body of revolution 2 and exerts an angular momentum, acting in the clockwise direction, on this body of revolution. If the body of revolution is now released by the brake, not shown here, then this body turns up to the stop 14, where it is again restrained. This position is depicted in FIG. 4*a*. In this position, the fluid emerging from the body of revolution 2 along the arrow P1′ flows past on the side of the neck 31.

As soon as the force exerted by the fluid on the piston 25 becomes weaker, during the rotation of the body of revolution 2, then the force of the hot gas G acting on the free annular surface 35, the double-diameter piston 24 in FIG. 4 is pushed downwards. As a result, the fluid present in the piston space 27 is pressed out of the piston space and flows via the borehole 32 along the arrow P5 to the outside. This discharging action can also be used to reinforce the rotating motion of the body of revolution 2. For this purpose, a control surface 37 is provided in the side wall of the body of revolution. It lies opposite the orifice of the neck 31. The fluid pressed out of the piston space 27 flows past this control surface and thereby exerts an angular momentum on the body of revolution, reinforcing its rotating motion in the direction of the first stop 14. If the piston 25 strikes against the bottom of the piston space 27, then the discharge nozzle 33 is completely released, so that hot gas G from the upper piston space 28 flows into and out of the discharge nozzle 33. The propelling jet can then be used to guide a missile.

If the brake for the body of revolution 2 is released once more, then the body of revolution rotates again into the position shown in FIG. 3*a*, and the interplay of forces can be repeated.

Figure 4B:
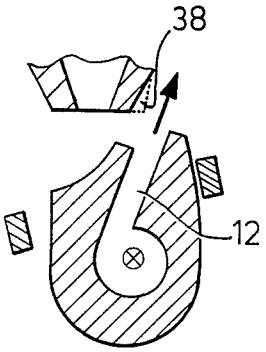

The mentioned reinforcement of the rotating motion of the body of revolution 2 by means of the fluid flowing out of the lower piston space 27 can also be achieved by means of a baffle edge 38, as represented in FIG. 4*b* with a dotted line. While the body of revolution 2 swivels, the fluid emerging from the exhaust passage 12 strikes this baffle edge, so that the angular momentum acting on the supporting surface 16 is maintained for a long time. Such a baffle edge 38 can also be provided when the rotating motion of the body of revolution is not reinforced by reverse-flowing fluid, as is possible in other application cases.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A fluid distributor comprising a body of revolution arranged around an axis of rotation and having a fluid passage communicating with a fluid source and with an exhaust passage, the exhaust passage being connected to said fluid passage and emerging from a side wall of the body of revolution, whereby fluid flows out of the exhaust passage as a fluid jet in a direction which does not intersect the axis of rotation of the body of revolution, setting the body of revolution into rotation, further comprising a restraining and releasing device for the body of revolution to retain the body of revolution in a fixed rotational position and to release the body of revolution out of the rotational position, and further comprising:

first and second stops for limiting the turning capacity of the body of revolution, whereby the body of revolution abutting against the first stop turns in the direction of the second stop, when said body of revolution is released by the restraining and releasing device;

a jet baffle unconnected with the body of revolution and lying opposite the exhaust passage of the body of revolution in the discharge direction of the fluid, when the body of revolution abuts against the second stop, and diverting a major portion of the fluid jet emerging from the exhaust passage in the direction of rotation; and a supporting surface provided on the body of revolution, the diverted fluid jet pushing against said supporting surface after emerging from the exhaust passage, so that body of revolution released by the restraining and releasing device is rotated from the second stop in the direction of the first stop and makes contact therewith.

2. The fluid distributor of claim 1, wherein the supporting surface is formed by a wall of the exhaust passage, drawn out on one side over the orifice of the exhaust passage, whereby the wall is situated in the direction of the first stop.

3. The fluid distributor of claim 1, wherein the baffle is formed as a deflector plate.

4. The fluid distributor of claim 1, wherein the baffle comprises a chamber to be filled with fluid emerging from the body of revolution.

5. The fluid distributor of claim 4, wherein a final controlling element to be regulated by the fluid emerging from the body of revolution is supported in the chamber.

6. The fluid distributor of claim 5, wherein the final controlling element is part of a valve controlling element of a switching-type valve.

7. The fluid distributor of claim 6, wherein the valve is a hot-gas valve.

* * * * *